US008533983B2

(12) United States Patent
Case

(10) Patent No.: US 8,533,983 B2
(45) Date of Patent: Sep. 17, 2013

(54) READERBOARD SYSTEM

(75) Inventor: Patrick T. Case, Poncha Springs, CO (US)

(73) Assignee: National Readerboard Supply Company, Poncha Springs, CO (US)

( * ) Notice: Subject to any disclaimer, the term of this patent is extended or adjusted under 35 U.S.C. 154(b) by 602 days.

(21) Appl. No.: 12/429,866

(22) Filed: Apr. 24, 2009

(65) Prior Publication Data

US 2009/0201224 A1 Aug. 13, 2009

Related U.S. Application Data

(63) Continuation of application No. 10/697,681, filed on Oct. 29, 2003, now Pat. No. 7,540,105.

(60) Provisional application No. 60/422,238, filed on Oct. 29, 2002.

(51) Int. Cl.
*G09F 7/02* (2006.01)

(52) U.S. Cl.
USPC ..... 40/618; 40/657

(58) Field of Classification Search
USPC ..... 40/618–622, 605, 657
See application file for complete search history.

(56) References Cited

U.S. PATENT DOCUMENTS

| | | | | |
|---|---|---|---|---|
| 4,035,940 | A | 7/1977 | Mickey et al. | |
| 4,265,040 | A * | 5/1981 | Sarkisian | 40/618 |
| 4,505,061 | A | 3/1985 | Neuburger et al. | |
| 5,606,834 | A | 3/1997 | Bauer | |
| 5,832,643 | A | 11/1998 | Delaquila et al. | |
| 6,178,678 | B1 | 1/2001 | Stoddard | |
| 6,216,375 | B1 | 4/2001 | Griffin | |
| 6,665,969 | B1 | 12/2003 | Conway | |
| 7,540,105 | B2 | 6/2009 | Case | |

OTHER PUBLICATIONS

Office Action for U.S. Appl. No. 10/697,681, mailed Dec. 17, 2004, 9 pages.
Final Office Action for U.S. Appl. No. 10/697,681, mailed Jun. 23, 2005, 8 pages.
Office Action for U.S. Appl. No. 10/697,681, mailed Aug. 12, 2005, 7 pages.
Final Office Action for U.S. Appl. No. 10/697,681, mailed Aug. 11, 2006, 11 pages.
Advisory Action for U.S. Appl. No. 10/697,681, mailed Oct. 31, 2006, 3 pages.
Office Action for U.S. Appl. No. 10/697,681, mailed Feb. 28, 2007, 9 pages.
Office Action for U.S. Appl. No. 10/697,681, mailed Oct. 9, 2007, 7 pages.
Office Action for U.S. Appl. No. 10/697,681, mailed Aug. 20, 2008, 7 pages.
Notice of Allowance for U.S. Appl. No. 10/697,681, mailed Jan. 27, 2009, 8 pages.
Zip-Change Numerals; 1 page information sheet, date unknown.
Zip-Change Numerals specification sheet, Wagner Zip-Change, Inc, Melrose Park, Illinois, 1 sheet (2000).

* cited by examiner

*Primary Examiner* — Casandra Davis
(74) *Attorney, Agent, or Firm* — Sheridan Ross P.C.

(57) ABSTRACT

A graphic panel system for providing a message spanning all or substantially all of a readerboard is provided. According to embodiments of the present invention, panel elements may be combined to form larger graphic images and textual messages. The individual panel elements may be single track height, even though they contain graphics or images that, when the panels are attached to a readerboard, extend for more than one row of the readerboard. Graphic panels having first color images are also provided.

17 Claims, 6 Drawing Sheets

READERBOARD SYSTEM

CROSS-REFERENCE TO RELATED APPLICATIONS

This application is a continuation of U.S. patent application Ser. No. 10/697,681, filed Oct. 29, 2003, which claims the benefit of U.S. Provisional Application No. 60/422,238, filed Oct. 29, 2002, the entire disclosures of which are hereby incorporated herein by reference.

FIELD OF THE INVENTION

The present invention relates to the provision of marquee graphic panels and to span-over marquee graphic panels. More particularly, the present invention relates to the provision of large, full color marquee graphic panels.

BACKGROUND OF THE INVENTION

Tracked readerboards or marquees provide tracks or slots in which two opposing edges of letter, number or word panels can be inserted. An example of a tracked readerboard 100 is shown in FIG. 1. As shown in FIG. 1, the readerboard 100 can accommodate word panels 104, letter or other character panels 108, and span-over panels 112. Readerboards are commonly used by retail stores, restaurants and other establishments to advertise offerings or to otherwise communicate information, because such readerboards 100 are relatively inexpensive, and can be readily changed to display different messages.

As shown in FIG. 2, taken along cross-section A-A of FIG. 1, word panels 104 and character panels 108 are typically provided in dimensions that allow such panels 104, 108 to occupy a single row 114 of the readerboard 100. The rows 114 are defined by tracks 116 having either one channel (e.g., tracks 116*a* and 116*c* at the top and bottom of the readerboard 100, respectively) or two channels (e.g., track 116*b*). With reference now to FIG. 3, a span-over panel 112 occupies at least a portion of two or more rows 114 of a readerboard 100. Accordingly, a span-over panel 112 allows a readerboard 100 having rows 114 of a first track height (or distance between tracks 116) to display panels having a height that is integral multiples of the provided row height, up to the total number of rows 114 provided by the readerboard 100. However, span-over panels 112 are prone to being blown out of a readerboard 100 by the wind.

A typical panel 104, 108 or 112 is formed on an acrylic substrate. Acrylic substrates have the advantage of being translucent, which is desirable when used in connection with readerboards 100 having internal lighting. Acrylic is also relatively inexpensive. However, acrylic is relatively brittle, and therefore panels 104-112 formed using acrylic substrates are easily broken, for example, when a panel 104-112 falls or is blown off of an elevated readerboard 100 onto pavement below.

The characters or words that have been used on panels 104-112 have been relatively simple and inexpensive to produce. For example, panels 104-112 may use characters formed from cut vinyl adhered to an acrylic substrate. Panels 104-112 may also have characters formed from ink deposited either directly on the acrylic panel or on an intermediate layer that is adhered to the acrylic substrate with relatively large blocks of a single, contiguous color. As a result, readerboard panels 104-112 usually are limited to the use of single colors, or of relatively large contiguous blocks of color, and relatively simple designs. Accordingly, readerboard panels have not featured full color graphic images. Furthermore, readerboard panel graphics have been limited in size, and have not extended across adjacent panels. Accordingly, readerboard panels have been limited in their visual impact. Large panels having graphics have been screwed to sign boards. However, the use of screws makes the panels difficult to attach and remove. In addition, such systems often damage the readerboard to which the graphic is attached. Accordingly, such systems have not been successful.

SUMMARY OF THE INVENTION

In accordance with an embodiment of the present invention, a marquee graphic panel or panel system is provided. The marquee graphic panel may include full color graphic elements. In addition, individual marquee graphic panels can be coordinated such that they can be combined to form a larger image. That is, individual panels may each comprise one portion of a larger image. In accordance with a further embodiment of the present invention, span-over panels may be combined with non-span-over panels, or span-over panels of different sizes. Furthermore, a number of non-span-over panels may be used in combination to present a larger image. For example, a number of individual panels may be used to create an image that covers all or a substantial portion of a readerboard to which the panels are attached. The panels are easily installed in or removed from a readerboard using the tracks of the readerboard.

According to an embodiment of the present invention, a full color marquee graphic panel is provided. According to such an embodiment, a full color graphic image is formed on a substantially non-breakable substrate, such as a polycarbonate resin. For example, a panel in accordance with the present invention may be formed on a LEXAN substrate. The full color graphic image may be formed either directly on the substrate, or on an intermediate layer that is adhered to the substrate. The full color graphic may be formed using an ink-jet process. In order to provide resistance to fading, the full color graphic may be formed from UV resistant inks, solvent based inks, and/or the image may be covered with a protective layer or film.

In accordance with another embodiment of the present invention, the graphic panel spans two or more rows of a readerboard or marquee. Accordingly, the panel may provide a relatively large surface on which to form the full color graphic image. In accordance with a further embodiment of the present invention, the full color graphic image is formed from four or more different colors of ink. According to still another embodiment of the present invention, the image is of photographic quality. Furthermore, the image may be formed using translucent inks, to provide a completed panel that is itself translucent.

In accordance with still another embodiment of the present invention, a method for advertising or promoting products or services is provided. According to the method, a full color graphic panel for use in connection with a readerboard is provided. The full color image depicts a product or service on offer. In addition, according to the method, a non-graphic reference to the image is presented, either proximate to the image, or removed from the image in time and/or space. For example, a full color graphic image positioned on a readerboard is displayed with a textual description of the product or service depicted in the image on the same readerboard. In accordance with another embodiment of the present invention, a non-graphical reference to the image is separated from the image in space. For example, a textual reference to the image may be made on a readerboard that is separate from the readerboard on which the full color graphic image is displayed.

In accordance with yet another embodiment of the present invention, the image may be displayed on a readerboard, for example, at a site offering the depicted product or service. The non-graphical reference to the full color image may be separated from the graphical image in space and time. For example, the non-graphical reference may be in the form of a radio or television commercial that is delivered to a consumer at a first time, while the consumer does not see the full color graphic panel until a second time.

These and other advantages and features of the invention will become more apparent from the following description of the invention taken together with the drawings.

DETAILED DESCRIPTION

Figure 1:
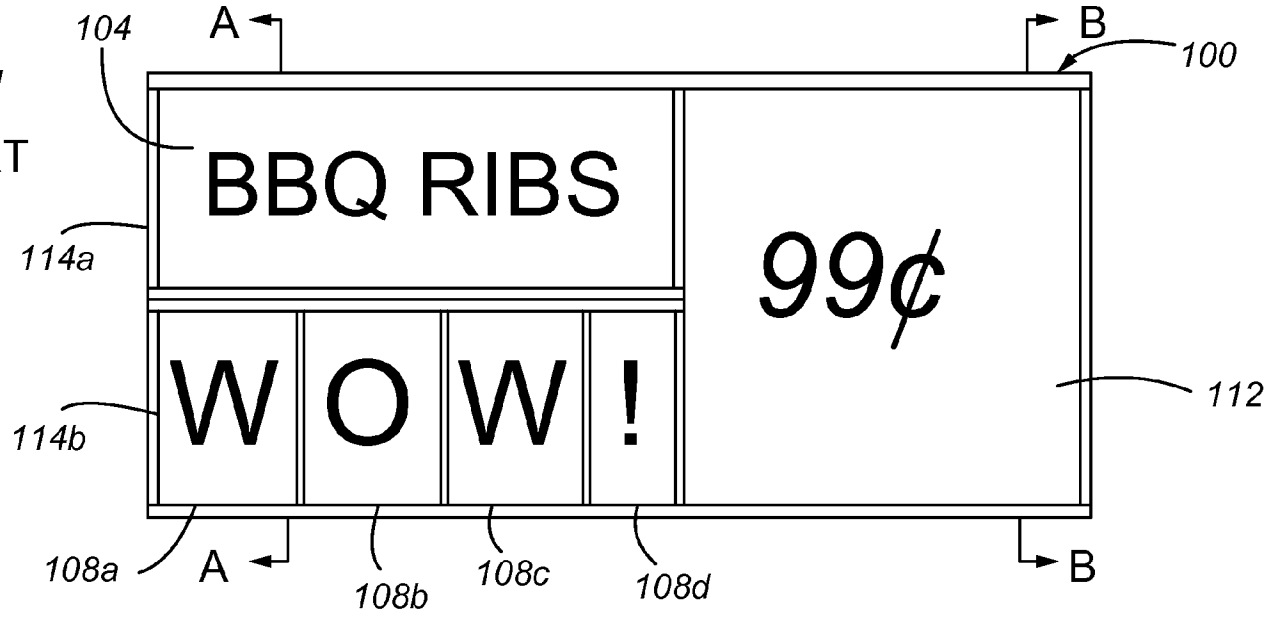
Fig. 1 PRIOR ART
FIG. 1 depicts a readerboard in accordance with the prior art.
Figure 2:
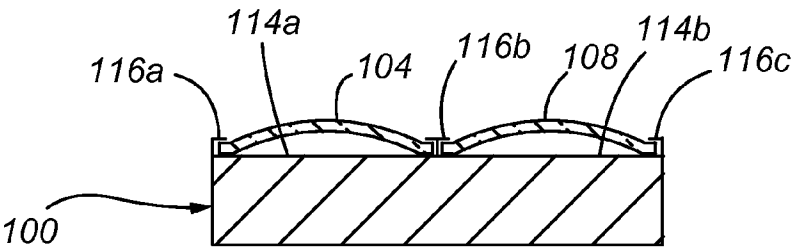
Fig. 2 PRIOR ART
FIG. 2 depicts the readerboard of FIG. 1 along cross-section A-A.
Figure 3:
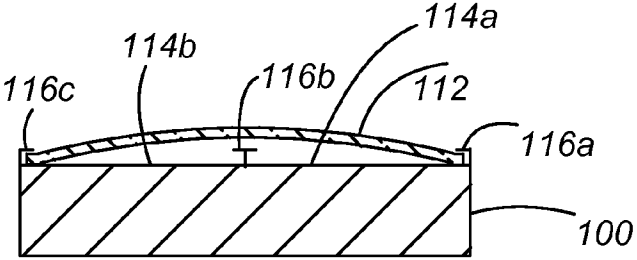
Fig. 3 PRIOR ART
FIG. 3 depicts the readerboard of FIG. 1 along cross-section B-B.
Figure 4:
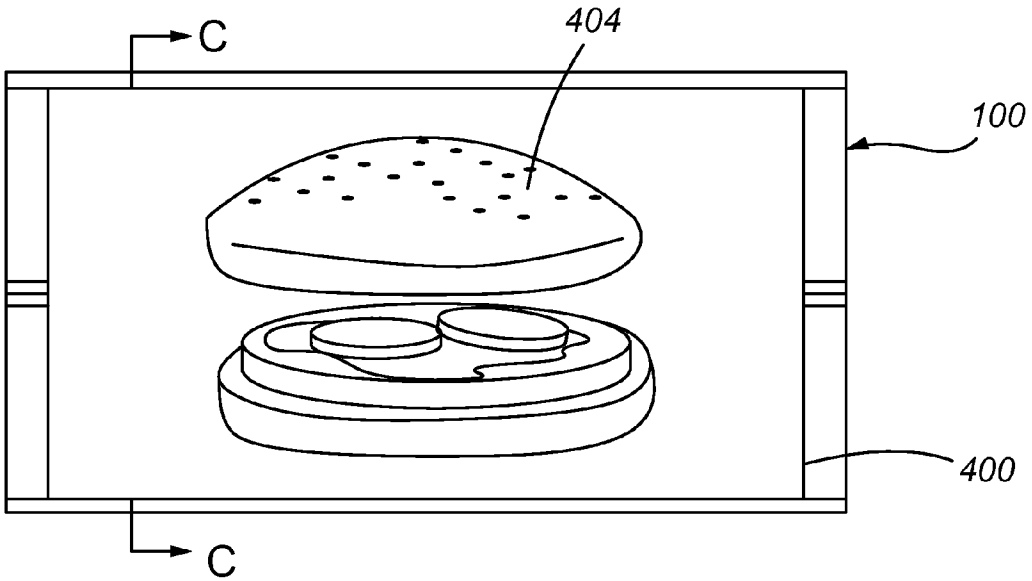
FIG. 4 depicts a full color graphic panel in accordance with an embodiment of the present invention.

With reference now to FIG. 4, a full size span-over graphic panel 400 in accordance with an embodiment of the present invention is illustrated. In general, the full-size span-over graphic panel 400 may be interconnected to a conventional readerboard or marquee 100. The full-size panel 400 includes a full color graphic image 404 depicting a product or service. The full color graphic image 404 is, according to an embodiment of the present invention, formed from four or more different colors of ink, allowing a full-spectrum of visible colors to be produced. Furthermore, the full color graphic image 404 may be of photographic quality. In accordance with an embodiment of the present invention, the image 404 is formed using cyan, magenta, yellow and black inks. Furthermore, an ink-jet process may be used to form the image 404.

Figure 5:
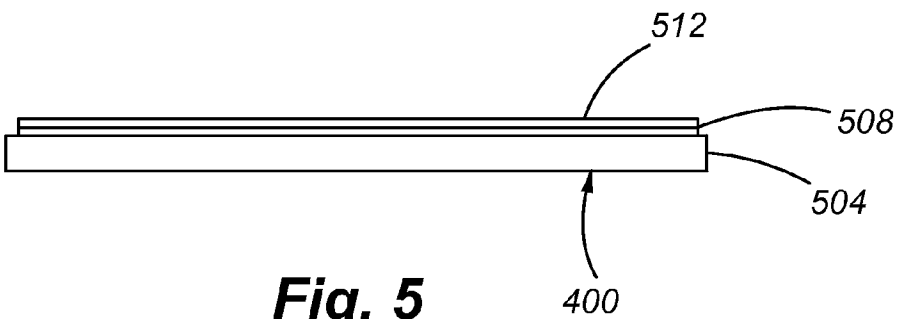
FIG. 5 depicts the full color graphic panel of FIG. 4 along cross-section C-C.

With reference now to FIG. 5, a full color span-over graphic panel 400 in accordance with an embodiment of the present invention is shown in an elevation taken along section line C-C of FIG. 4. As shown in FIG. 5, the full color span-over graphic panel 400 may include a substrate 504, an image layer 508, and a protective layer 512. In accordance with an embodiment of the present invention, the substrate 504 comprises a PETG or LEXAN panel. LEXAN provides a panel 400 that is translucent. In addition, a LEXAN is relatively resistant to breakage due to impacts, making it well-suited for use in connection with the presentation of images 404 that are relatively costly to produce, either because of their size or their quality. The image layer 508 generally provides a surface on which the image 404 is formed. For example, the image layer 508 may comprise a vinyl sheet, a paper sheet, or a MYLAR film on which the image 404 is formed by the deposition of ink using an ink jet printer. For instance, the image layer may comprise a self-adhesive vinyl sheet. As a further example, the image layer 508 may be interconnected to the substrate 504 using an adhesive. In accordance with an embodiment of the present invention, an adhesive used to interconnect the substrate 504 and image layer 508 provides good adhesion over a wide range of weather conditions. Such qualities are particularly important in connection with readerboards 100 placed in outdoor locations.

The protective layer 512 generally comprises a transparent film or layer adhered to the image layer 508. The protective layer 512 may function to protect the image layer 508 from weathering, including protecting the image 404 from fading due to exposure to sunlight. Accordingly, this protective layer 512 may comprise a sun screen.

In accordance with another embodiment of the present invention, the image 404 is formed from fade resistant inks or processes. For example, the image 404 may be formed using solid based inks. As a further example, the image 404 may be found using solvent based inks. The inks may be UV light resistant, to provide fade resistance when the graphic panel 400 is used outdoors. Therefore, a protective layer 512 need not be provided in connection with such an embodiment. Furthermore, a protective layer 512 may be omitted where the panel 400 will be displayed in an indoor or an otherwise protected location.

By providing for a full-size span-over panel 400 with a full color graphic image 404, relatively large images (i.e., images as large or about as large as a surface of a readerboard 100) can be displayed using a single panel 400. Furthermore, because the full-size panel 400 is compatible with conventional readerboards 100, the panel 400 can be easily and conveniently displayed or taken off of display, for example, to coincide with advertising campaigns related to the depicted product or service.

Figure 6:
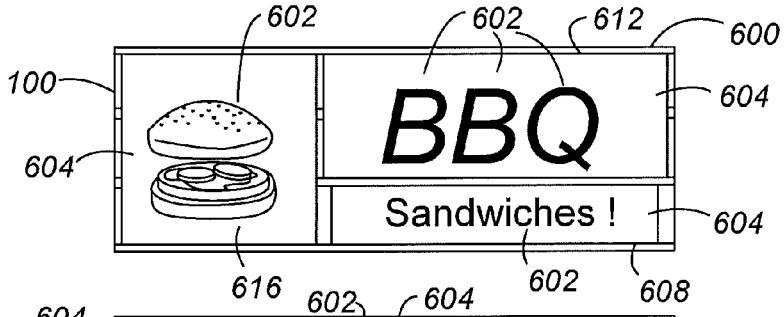
FIG. 6 depicts a graphic panel system in accordance with an embodiment of the present invention.

With reference now to FIG. 6, an embodiment of a readerboard or graphic panel system 600 in accordance with another embodiment of the present invention is illustrated. In general, the graphic panel system 600 includes a number of panel elements 604. As shown in FIG. 6, the panel elements 604 may include single track-height (i.e., non-span-over track height) panels 608, double track height (span-over) panels 612, and triple track height (span-over) panels 616. Panel elements 604 spanning more than three rows or track heights may also be provided. Because panel elements 604 in integer multiples of rows or track heights 114 are provided, the panel elements 604 may be interconnected to a conventional tracked readerboard 100. In addition, as also shown in FIG. 6, the panel elements 604 may have different lengths. For example, the panel elements 604 may have a length that is about equal to one-third of the length of a track.

The readerboard system 600 shown in FIG. 6 allows great flexibility in and combinations of graphic elements and descriptive (textual or numeric) elements, collectively referred to herein as semiotic elements 602. Furthermore, as used herein, the term semiotic elements may include stylized text, background colors or blank panels. Semiotic elements 602 that lend themselves to display using a panel element 604 having a single row or track height may be placed on single track height panel elements 608. Likewise, semiotic elements 602 that lend themselves to being displayed using panel elements 604 spanning two rows 114 may be formed on two track height elements 612. Furthermore, semiotic elements 602 lending themselves to display on panel elements 604 spanning three rows 114 may be displayed on panel elements spanning three tracks 616. As can be appreciated from the description provided herein, if panel elements 604 spanning more than three rows 114 are provided, then such panel elements 604 may be used in connection with semiotic elements 602 spanning more than three rows 114 on a single panel element 604.

As illustrated in the example readerboard system 600 of FIG. 6, by providing a number of panel elements 604 in different sizes, different panel elements 604 can be combined or arranged in different ways to provide different or updated messages, without requiring changing other of the panel elements 604. For example, a panel 604 containing a semiotic element 602 that uses text to describe a semiotic element 602 comprising a picture of an item on another panel element 604 can be changed without requiring removal of the panel element 604 containing the picture. As used herein, the term "message" includes or refers to text and/or graphics formed from semiotic elements 602 contained on one or more panel elements 604.

Figure 7:
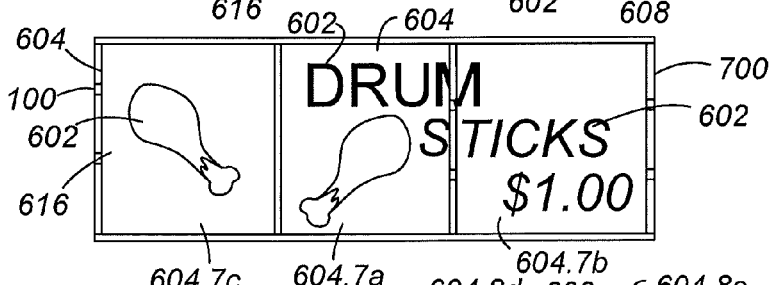
FIG. 7 depicts a graphic panel system in accordance with another embodiment of the present invention.

With reference now to FIG. 7, a readerboard system 700 in accordance with another embodiment of the present invention is illustrated. In the example of FIG. 7, panel elements 604 comprising three track height span-over panels 616 are shown interconnected to a conventional readerboard 100. Furthermore, the panel elements 604 in FIG. 7 contain semiotic elements 602 that produce, in combination, a continuous or substantially continuous graphic image and/or message. In particular, panel 604.7*a*, and panel 604.7*b*, when viewed together, spell the words "DRUM" and "STICKS". If panel 604.7*a* were viewed separately from 604.7*b*, only a portion of each of the words would be viewable. Accordingly, panels 604.7*a* and 604.7*b* each contain a portion of an integrated message, rather than each containing an image or text that is complete when viewed in isolation. Furthermore, the panels 604.7*a* and 604.7*b* have semiotic elements 602 that are complementary to one another, in that the semiotic elements acquire meaning or completeness as a message or graphic when they are viewed together. Panel 604.7*c* may also contribute to the overall impression provided by the panel element 604 of the system 700. For example, in the illustrated example, panel 604.7*c* contains an image of a drumstick. Therefore, panel 604.7*c* is complementary to panels 604.7*a* and 604.7*b*. In addition, panel 604.7*c* may form part of a continuous image, particularly if graphic elements extend across the borders between panels 604.7*a* and 604.7*c*, or if panel 604.7*c* has the same background color as panel 604.7*a*.

The readerboard system 700 illustrated in FIG. 7 allows large graphic images, text, or combinations of images and text to be displayed across all or substantially all of a readerboard 100 using a number of panel elements 604. Accordingly, the graphic image system 700 allows a relatively large, integrated textual message and/or a graphic display to be placed on the readerboard 100 using individual panel elements 604 that are smaller, and therefore more easily handled, then a panel element that covers or extends across all or substantially all of a surface of the readerboard 100 (e.g., full size span-over graphic image panel 400). Ease of handling is of particular concern where the readerboard 100 is in an elevated or otherwise difficult to reach location.

Figure 8:
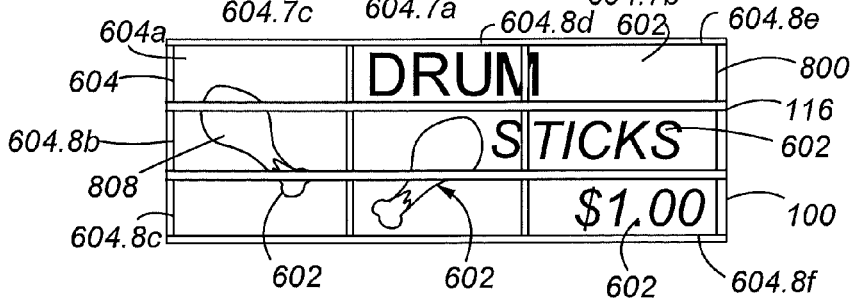
FIG. 8 depicts a graphic panel system in accordance with another embodiment of the present invention.

With reference now to FIG. 8, a readerboard system 800 in accordance with another embodiment of the present invention is illustrated. As shown in FIG. 8, the readerboard system 800 comprises a number of panel elements 604. In particular, the panel elements 604 of the readerboard system 800 have a single row or track height and a partial track length. As illustrated in FIG. 8, the individual panel elements 604 may contain semiotic elements 602 that, when viewed in combination, present a message that occupies all or substantially all of the area of a readerboard 100. Accordingly, substantially continuous graphic elements (e.g., drumstick 808) may be presented across two or more of the panel elements 604. For instance, drumstick 808 spans three separate panel elements 604.8*a -c* Similarly, textual elements may span two or more panel elements 604. For example, the word "DRUM"in FIG. 8 spans panel elements 604.8*d* and 604.8*e*. The graphic panel system 800 may also present one or more semiotic elements 602 that are contained within a single panel element 604. For example, in FIG. 8 the price "$1.00" is entirely contained within a single panel element 604.8*f*. Accordingly, by changing panel element 604.8*f* and only panel element 604.8*f*, the price of the item displayed and/or described on other of the panel elements 604 can be easily changed to reflect different market conditions. Furthermore, the panel element 604.8*f* can be visually integrated into the overall message presented by the other panel elements 604 by using the same background or a background that continues or echos semiotic elements 602 displayed by the other panel elements 604.

By providing a number of relatively small, like-sized panel elements 604, the graphic panel system 800 allows messages to be easily placed on the message board 100. In addition, because the panel elements 604 are single row height, they are more resistant to being blown out of the readerboard 100 by high winds than are span-over panels. Also, is relatively small printers can be used, if desired, to produce the semiotic elements. Accordingly, a graphic panel system such as the system 800 shown in FIG. 8 allows messages to visually span all or substantially all of a readerboard 100, but can be made up of relatively small panel elements 604 containing semiotic elements 602 that comprise a portion of the overall message. Furthermore, even though opaque tracks 116 may cause breaks in the overall message, this is typically not noticeable to passers-by who glance at the readerboard 100 or who are traveling past the readerboard 100 in a vehicle. That is, the human brain will fill in the gaps between the panel elements 604, and the overall message will be communicated to that passer-by.

Figure 9:
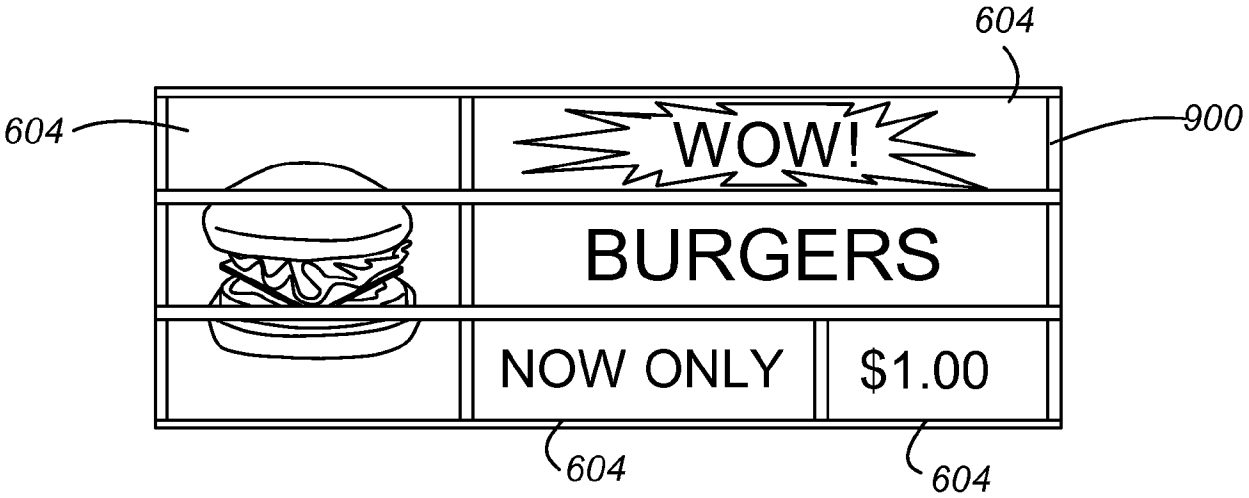
FIG. 9 depicts a graphic panel system in accordance with another embodiment of the present invention.

With reference now to FIG. 9, a graphic panel system 900 in accordance with another embodiment of the present invention is illustrated. As shown in FIG. 9, graphic panel system 900 may make use of a variety of different single row or track height panel elements 604. Accordingly, the elements of an overall message can be selectively changed. In addition, single track height panels 604 having lengths appropriate to the included semiotic element 602 can be provided. Furthermore, because the panel elements 604 are all single row or track height, the graphic panel system 900 provides good resistance to blow down, and easy assembly.

Figure 10:
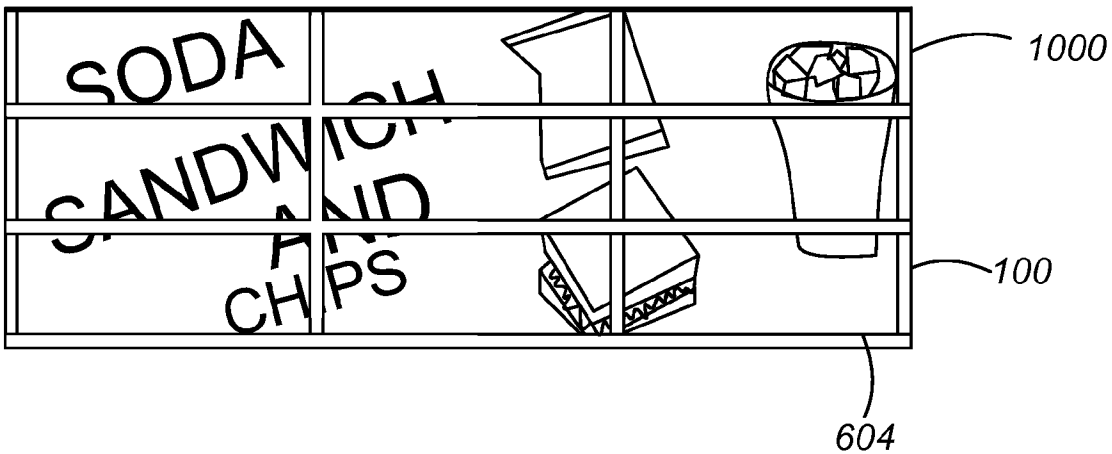
FIG. 10 depicts a graphic panel system in accordance with another embodiment of the present invention.

With reference now to FIG. 10, a graphic panel system 1000 in accordance with still another embodiment of the present invention is illustrated. In particular, a system 1000 comprising a number of regularly sized, single track height panel elements 604 is illustrated. Furthermore, the individual panel elements 604 may contain graphics and/or text intended for viewing as an integrated whole. That is, each of the individual panels 604 is an integral part of an overall message. Accordingly, the graphic panel system 1000 illustrates how embodiments of the present invention can provide integrated messages spanning all or substantially all of a readerboard 100.

Figure 11:
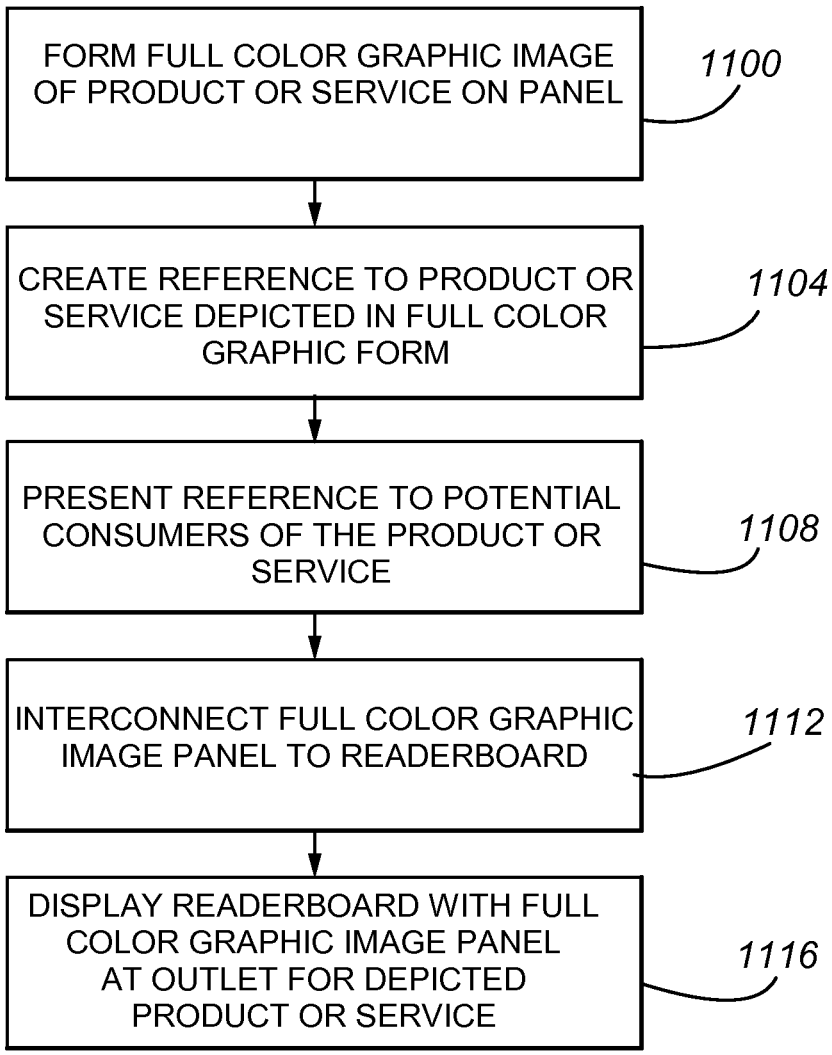
FIG. 11 is a flow chart depicting a method in accordance with an embodiment of the present invention.

With reference now to FIG. 11, a method in accordance with an embodiment of the present invention is depicted. In particular, at step 1100, a full color graphic image of the product or service being promoted is formed on a panel 400. For example, an inkjet printer is used to form a full color graphic image 404 on an image layer 508 that is laminated or adhered to a substrate 504 and covered by a protective layer 512. At step 1104, a reference to a depicted product or service is created. For example, a broadcast media advertisement referring to the product or service depicted in the full color graphic image 404 is created. For instance, a restaurant franchise may create a television advertisement referring to and displaying an image of the sandwich that is also depicted in the panel 400.

At step 1108, the created reference is presented to potential consumers of the product or service depicted in the image 404 on the panel 400. For example, the television commercial concerning the featured sandwich is aired.

At step 1112, the full color graphic image panel 400 with the image 404 depicting the product or service being promoted is interconnected to a readerboard 100. The readerboard 100, with the full color graphic image panel 400, is then displayed at an outlet for the depicted product or service. For example, to continue the example of a restaurant promoting a sandwich, the panel 400 with the image 404 of the sandwich is displayed on a readerboard outside of a franchise outlet (step 1116).

Figure 12:
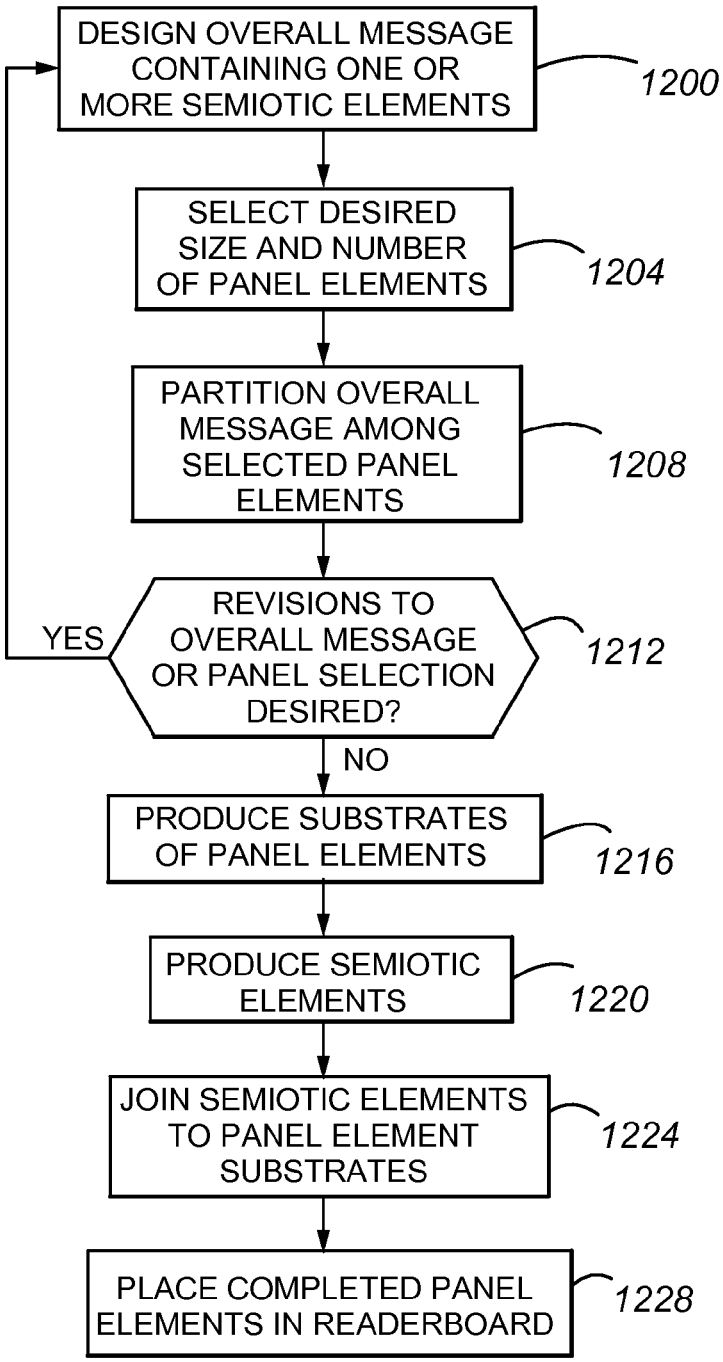
FIG. 12 is a flow chart depicting a method in accordance with another embodiment of the present invention.

With reference now to FIG. 12, a method in accordance with another embodiment of the present invention is depicted. In particular, at step 1200, an overall message containing one or more semiotic elements 602 is designed. Next, a desired number and size of panel elements 604 is selected. At step 1208, the overall message is partitioned among the selected panel elements 604. As can be appreciated by one of skill in the art, the steps of designing a message, selecting an arrangement of panel elements 604 and partitioning the overall message such that semiotic elements 602 are appropriately distributed on panel elements 604 can be performed substantially simultaneously. Furthermore, in different instances, different ordering of the steps may be appropriate. For example, a decision to use a number of single track height, less than full width panel elements 604 may be made initially, and the overall message would then be partitioned accordingly. Alternatively, the use of different sized panel elements 604 may be desirable where an overall message incorporating semiotic elements 602 comprising large graphical images and text that is likely to be changed independently of the graphical elements (e.g., a sales price) comprise the overall message.

At step 1212, a determination is made as to whether revisions to the overall message or panel selection is desired. For example, after laying out the overall message among the selected panel elements, it may become apparent that a modified arrangement would be preferable. After an arrangement has been decided upon, the substrates of the panel elements 604 are produced (step 1216). At step 1220, the semiotic elements 602 are produced. The semiotic elements 602 are then joined to the panel element substrates to produce completed panel elements 604 (step 1224). As can be appreciated by one of skill in the art, the particular processes involved in the completion of steps 1216, 1220 and 1224 will depend upon the selected materials and techniques for producing the panel elements 604. For example, in accordance with an embodiment of the present invention, the substrates of the panel elements are formed from LEXAN, and the semiotic elements 602 are formed by using an ink jet printer to place solvent based inks on a vinyl or MYLAR film. Continuing the present example, the MYLAR film on which the semiotic element or elements 602 has been printed is then adhered to the substrate. A sun screen film may then be applied over the MYLAR film on which the semiotic elements have been printed in order to provide resistance against fading due to exposure to the sun.

The completed panel elements 604 may then be placed in a readerboard 100 (step 1228). As can be appreciated from the description provided herein, in the present example, the overall message is represented using a number of semiotic elements placed on a number of panel elements 604. Accordingly, the order and the arrangement of the panel elements 604 in the readerboard 100 will generally be determined by the overall message. Usually, the correct ordering of the panel elements 604 in the readerboard 100 will be obvious to the installer. However, for example if a large number of panel elements 604 are used, the panel elements 604 may be numbered or otherwise coded to assist the installer in placing each panel element 604 in the correct position on the readerboard 100.

The inventor of the present invention has recognized that graphical images depicting a product or service can be a powerful draw to consumers. Furthermore, the inventor has recognized that readerboards provide an existing and convenient means for displaying such graphical images. However, there heretofore has been no viable way of displaying a relatively large graphical image in connection with a readerboard. In addition, it has been shown that the use of a readerboard displaying a full-color graphical image to promote a product or service can have a dramatic positive effect on sales of that product or service. For example, studies have shown that a readerboard displaying textual characters formed from letter panels 108 promoting a product or service can increase sales by 87%. Furthermore, it has been determined that the use of full color span-over graphic panels 400 with a graphic image 404 in accordance with the present invention depicting a featured product or service can increase sales by more than 240%. Accordingly, the present invention provides advantages that were previously unavailable using prior art panels 104-112. Furthermore, the magnitude of the increased sales associated with the use of embodiments of the present invention was much greater than expected. In particular, although some increase in sales was expected (e.g., 100%), the 240% or greater increase actually experienced was unexpected.

In addition, systems in accordance with embodiments of the present invention have met with considerable commercial success. For example, sales of panel elements having semiotic elements distributed thereon in accordance with embodiments of the present invention have been tested by major restaurant chains, and these tests have resulted in larger orders. For instance, McDonald's® ordered panel systems in accordance with an embodiment of the present invention for four restaurants and, based on the results of that initial test, ordered systems for an additional 80 stores. As a further example, a Sonic® restaurant ordered a system in accordance with an embodiment of the present invention. As a result of the success experienced by that restaurant, systems in accordance with embodiments of the present invention were ordered for an additional 8 stores. Sonic® then ordered systems in accordance with embodiments of the present invention for another 80 stores. As a further example of the commercial success of systems in accordance with embodiments of the present invention, Long John Silvers® is considering 3,600 systems for use in connection with its restaurants. As yet another example, a test of a system in accordance with an embodiment of the present invention at a Dairy Queen® restaurant has resulted in orders for an additional 50 systems.

In addition, embodiments of the present invention have been met with initial skepticism. For example, the customer who ordered the first system for the Sonic® restaurant in the above example expressed doubt that the system would improve sales. The actual increase in sales that were in fact experienced eventually lead to the order for systems for 80 Sonic® restaurants.

As can be appreciated from the description provided herein, embodiments of the present invention also provide images or messages that can be easily changed. For example, a graphic or image formed on multiple panel elements can be installed on a readerboard in under 3 minutes.

The foregoing discussion of the invention has been presented for purposes of illustration and description. Further, the description is not intended to limit the invention to the forms disclosed herein. Consequently, variations and modifications commensurate with the above teachings, within the skill and knowledge of the relevant art, are within the scope of the present invention. The embodiments described hereinabove are further intended to explain the best mode presently known of practicing the invention and to enable others skilled in the art to utilize the invention in such or in other embodiments and with various modifications required by their particular application or use of the invention. It is intended that the appended claims be construed to include the alternative embodiments to the extent permitted by the prior art.

What is claimed:

1. A readerboard system, comprising:

a readerboard, including:

a first track, wherein the first track extends from a surface of the readerboard and has an L or T-shaped cross-section;

a second track, wherein the second track extends from the surface of the readerboard and has a T-shaped cross-section;

a third track, wherein the third track extends from the surface of the readerboard and has an L or T-shaped cross-section, wherein the first and second tracks define the first row of the readerboard, and wherein the second and third tracks define a second row of the readerboard;

a first panel element, wherein the first the first panel element is a substantially planar panel, wherein a top edge of the first panel element is placed in a first channel of the first track of the readerboard, wherein a bottom edge of the first panel element is placed in a first channel of the second track of the readerboard, wherein the first panel element includes first and second side edges, wherein a first semiotic element that extends to at least a portion of the bottom edge and to at least a portion of the second side edge of the first panel element is formed on a first surface of the first panel element, wherein at least a portion of the first semiotic element that extends to the bottom edge of the first panel element underlies a portion of the second track of the readerboard, and wherein the first semiotic element includes a first portion of a first graphical image;

a second panel element, wherein the second panel element is a substantially planar panel, wherein a top edge of the second panel element is placed in a second channel of the second track of the readerboard, wherein a bottom edge of the second panel element is placed in a first channel of the third track of the readerboard, wherein the second panel element includes first and second side edges, wherein a second semiotic element that extends to at least a portion of the top edge and to at least a portion of the second side edge of the second panel element is formed on a first surface of the second panel element, wherein at least a portion of the second semiotic element that extends to the top edge of the second panel element underlies a portion of the second track of the readerboard, wherein the second semiotic element includes a second portion of the first graphical image, and wherein the top edge of the second panel element is adjacent the bottom edge of the first panel element;

a third panel element, wherein the third panel element is a substantially planar panel, wherein a top edge of the third panel element is placed in the first channel of the first track of the readerboard, wherein a bottom edge of the third panel element is placed in the first channel of the second track of the readerboard, wherein the third panel element includes first and second side edges, wherein the third panel element is placed in the readerboard such that the first side edge of the third panel element is adjacent the second side edge of the first panel element, wherein a third semiotic element that extends to at least a portion of the bottom edge and to at least a portion of the first side edge of the third panel element is formed on a first surface of the third panel element, wherein at least a portion of the third semiotic element that extends to the bottom edge of the third panel element underlies a portion of the second track of the readerboard, and wherein the third semiotic element includes a third portion of the first graphical image;

a fourth panel element, wherein the fourth panel element is a substantially planar panel, wherein a top edge of the fourth panel element is placed in the second channel of the second track of the readerboard, wherein a bottom edge of the fourth panel element is placed in the first channel of the third track of the readerboard, wherein the fourth panel element includes first and second side edges, wherein the fourth panel element is placed in the readerboard such that the first side edge of the fourth panel element is adjacent the second side edge of the second panel element, wherein a fourth semiotic element that extends to at least a portion of the top edge and to at least a portion of the first side edge of the fourth panel element is formed on a first surface of the fourth panel element, wherein the fourth semiotic element includes a fourth portion of the first graphical image, wherein at least a portion of the fourth semiotic element that extends to the top edge of the fourth panel element underlies a portion of the second track of the readerboard, and wherein the top edge of the fourth panel element is adjacent the bottom edge of the third panel element, wherein the first, second, third, and fourth semiotic elements are complementary such that they combine to form a complete first graphical image, wherein the first and second panel elements and the first and second semiotic elements are separated from one another by at least a first portion of the second track of the readerboard, wherein the third and fourth panel elements and the third and fourth semiotic elements are separated from one another by at least a second portion of the second track of the readerboard, wherein the first and third semiotic elements are adjacent one another, and wherein the second and fourth semiotic elements are adjacent one another.

2. The system of claim 1, wherein the complete first graphical image includes a photograph.

3. The system of claim 1, wherein the first semiotic element includes a first portion of a first textual character, wherein the second semiotic element includes a second portion of the first textual character, and wherein a substantially continuous message formed by the first and second semiotic elements includes a complete representation of the first textual character.

4. The system of claim 1, wherein the first graphical image includes at least a portion of a textual character.

5. The system of claim 1, wherein the first and second panel elements do not include any protrusions for engaging the tracks of the readerboard.

6. The system of claim 1, wherein the first, second, third, and fourth semiotic elements are complementary in that they combine to form the complete first graphical image, and wherein the first graphical image includes an image of an object.

7. The system of claim 1, wherein each of the panel elements has a height of one row of the readerboard.

8. The system of claim 1, wherein a length of the panel elements is less than a length of a row of the readerboard.

9. A readerboard system, comprising:

a readerboard, the readerboard including a plurality of tracks, wherein each track includes at least one channel;

a plurality of panel elements, including at least first, second, third, and fourth substantially planar panel elements, wherein each panel element includes:

a substrate, wherein the substrate has a height that is sized to span an integer number of readerboard rows, and wherein the substrate includes a top edge, a bottom edge, a first side edge, and a second side edge; and a semiotic element interconnected to the substrate, wherein semiotic elements on each of the first, second, third, and fourth panel elements combine to form a complete graphic image that spans more than one of the readerboard rows, wherein the top edge of each of the first and third panel elements is held within a first channel of a first track, wherein the bottom edge of each of the first and third panel elements is held within a first channel of a second track, wherein the top edge of each of the second and fourth panel elements is held within a second channel of the second track, and wherein the bottom edge of each of the second and fourth panel elements is held in a first channel of a third track;

wherein a first portion of the complete graphic image is depicted by the semiotic element included in the first panel element, wherein a second portion of the complete graphic image is depicted by the semiotic element included in the second panel element, wherein a third portion of the complete graphic image is depicted by the semiotic element included in the third panel element, wherein a fourth portion of the complete graphic image is depicted by the semiotic element included in the fourth panel element, wherein the first, second, third, and fourth portions of the complete graphic image are complementary such that the first, second, third, and fourth portions of the complete graphic image combine to form one of the entire graphic image or a larger portion of the complete graphic image when the first, second, third, and fourth panel elements are arranged such that the second side edge of the first panel element is adjacent the first side edge of the third panel element, the second side edge of the second panel element is adjacent the first side edge of the fourth panel element, the bottom edge of the first panel element is adjacent the top edge of the second panel element, and the bottom edge of the third panel element is adjacent the top edge of the fourth panel element, wherein the first and second portions of the complete graphic image are adjacent to one another and are separated from one another by the second track of the readerboard, wherein the third and fourth portions of the complete graphic image are adjacent to one another and are separated from one another by the second track of the readerboard, wherein portions of the complete graphic image adjacent the bottom edges of the first and third panel elements are within the first channel of the second track and underlie the second track, and wherein portions of the complete graphic image adjacent the top edges of the second and fourth panel elements are within the second channel of the second track and underlie the second track.

10. The system of claim 9, wherein each of the panel elements includes a semiotic element that includes a portion of an image of an object included in the complete graphic image.

11. The system of claim 9, wherein the first and second panel elements do not overlap one another.

12. The system of claim 11, wherein the first and third panel elements do not overlap one another.

13. The system of claim 9, wherein the first panel element includes a first portion of a first textual character, wherein the second panel element includes a second portion of the first textual character, wherein when the first and second panel elements are aligned with one another in the readerboard at least a portion of a complete representation of the first textual character has a location that corresponds to the second track of the readerboard separating the first and second panel elements.

14. The system of claim 13, wherein at least some of the at least a portion of a complete representation of the first textual character that has a location that is within at least one of the first and second channels of the second track of the readerboard.

15. A method for presenting information, comprising:

distributing a complete graphic image across a plurality of planar panel elements, wherein the at least four panel elements present the complete graphic image to a viewer when the panel elements are aligned with one another such that a bottom edge of a first one of the plurality of panel elements is adjacent a top edge of a second one of the plurality of panel elements, such that a bottom edge of a third one of the plurality of panel elements is adjacent a top edge of a fourth one of the plurality of panel elements, such that a side edge of the first panel element is adjacent a side edge of the third panel element, and such that a side edge of the second panel element is adjacent a side edge of the fourth panel element;

placing the first and third panel elements in a first row of a readerboard, wherein the bottom edge of each of the first and third panel elements is held within a first channel of a first track of the readerboard, and wherein at least a portion of the complete graphic image is within the first channel of the first track;

placing the second and fourth panel elements in a second row of the readerboard, wherein the second row of the readerboard is adjacent the first row of the readerboard, wherein a top edge of each of the second and fourth panel elements is within a second channel of the first track of the readerboard, wherein at least a portion of the complete graphic image is within the second channel of the first track of the readerboard, and wherein the graphic image is presented to a viewer.

16. The method of claim 15, wherein the graphic image presents an image of an object to the viewer.

17. The method of claim 15, wherein the graphic element comprises a plurality of textual characters, wherein at least a first portion of a first textual character is included on first panel element, and wherein a second portion of the textual character is included on the second panel element.

* * * * *